US008701883B1

(12) United States Patent
Pajestka

(10) Patent No.: US 8,701,883 B1
(45) Date of Patent: Apr. 22, 2014

(54) FLOWER ARRANGEMENT ASSEMBLY

(71) Applicant: Mary Ann Pajestka, Sonora, TX (US)

(72) Inventor: Mary Ann Pajestka, Sonora, TX (US)

(73) Assignee: Mary Ann Pajestka, Sonora, TX (US)

( * ) Notice: Subject to any disclaimer, the term of this patent is extended or adjusted under 35 U.S.C. 154(b) by 0 days.

(21) Appl. No.: 13/787,332

(22) Filed: Mar. 6, 2013

(51) Int. Cl.
*B65D 85/50* (2006.01)

(52) U.S. Cl.
USPC ..... 206/423; 248/27.8

(58) Field of Classification Search
USPC ..... 206/423, 457; 248/27.8, 318, 149, 154
See application file for complete search history.

(56) References Cited

U.S. PATENT DOCUMENTS

| | | | | |
|---|---|---|---|---|
| 1,579,305 | A | 4/1926 | Goldberg | |
| 2,573,372 | A * | 10/1951 | Wagler | 248/27.8 |
| 3,374,575 | A * | 3/1968 | Tong | 47/41.12 |
| 3,452,476 | A * | 7/1969 | Kise | 47/55 |
| 4,223,859 | A * | 9/1980 | Erickson | 248/154 |
| 5,547,721 | A | 8/1996 | Kuo | |
| 5,645,168 | A | 7/1997 | Honkawa | |
| 5,836,105 | A * | 11/1998 | Loosen | 47/39 |
| 6,120,283 | A | 9/2000 | Cousins | |
| 6,425,555 | B1 * | 7/2002 | Hedeman | 248/27.8 |
| 6,971,613 | B2 * | 12/2005 | Shendelman | 248/150 |
| 6,993,868 | B2 | 2/2006 | Hronyetz | |
| 7,096,623 | B2 | 8/2006 | Cardamone et al. | |
| D581,035 | S | 11/2008 | Conway et al. | |
| D588,252 | S | 3/2009 | Conway et al. | |
| 7,524,187 | B2 | 4/2009 | Kubicek et al. | |
| 7,614,876 | B1 | 11/2009 | Ward-Kubik | |
| D625,851 | S | 10/2010 | Furner et al. | |
| 8,276,315 | B2 | 10/2012 | Meisinger et al. | |
| 8,333,585 | B2 | 12/2012 | Theresa et al. | |

FOREIGN PATENT DOCUMENTS

| | | |
|---|---|---|
| DE | 20311620 U1 | 1/2004 |
| DE | 20311620 U1 | 2/2004 |

* cited by examiner

*Primary Examiner* — Jacob K Ackun
(74) *Attorney, Agent, or Firm* — Conley Rose, PC

(57) ABSTRACT

A flower bowl, including a body including a central axis, a first end, a second end, and a receptacle extending axially therein from the first end, the receptacle configured to receive an arrangement of flowers. The flower bowl further includes a projection extending from the second end, the projection further comprising a frustoconical engagement surface. The engagement surface is configured to engage an opening of a candle jar.

6 Claims, 3 Drawing Sheets

FLOWER ARRANGEMENT ASSEMBLY

BACKGROUND

Flower arrangements are a common gift which is exchanged between individuals in modern society. One limitation of a flower arrangement is that the flowers disposed within the arrangement have a relatively short life span. As a result, a gift or purchase of flowers may only be displayed or kept for a relatively short period of time before the flowers begin to wither thus greatly diminishing the aesthetic value thereof. Upon the expiration of the usable life of the arrangement, the recipient is forced to dispose of the flowers, thus eliminating most of the contents of the gift or purchase.

SUMMARY

The present disclosure relates to a flower bowl. In an embodiment, the flower bowl comprises a body including a central axis, a first end, a second end, and a receptacle extending axially therein from the first end, the receptacle configured to receive an arrangement of flowers. In addition, the flower bowl comprises a projection extending from the second end, the projection further comprising a frustoconical engagement surface. The engagement surface is configured to engage an opening of a candle jar.

Some embodiments are directed to a flower arrangement assembly. In an embodiment, the flower arrangement assembly comprises a candle jar, with a recess, the recess including an opening with a first diameter D1. In addition, the flower arrangement assembly comprises a flower bowl. The flower bowl further comprises a body including a central axis, a first end, a second end, and a receptacle extending axially therein from the first end, the receptacle configured to receive an arrangement of flowers. The flower bowl additionally comprises a projection extending from the second end, the projection further comprising a proximal end, a distal end opposite the proximal end, a frustoconical engagement surface and an outer diameter D2. Wherein D2 is less than D1, and the projection is received within the opening.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of exemplary embodiments of the invention, reference will now be made to the accompanying drawings in which.

DETAILED DESCRIPTION

Figure 1:
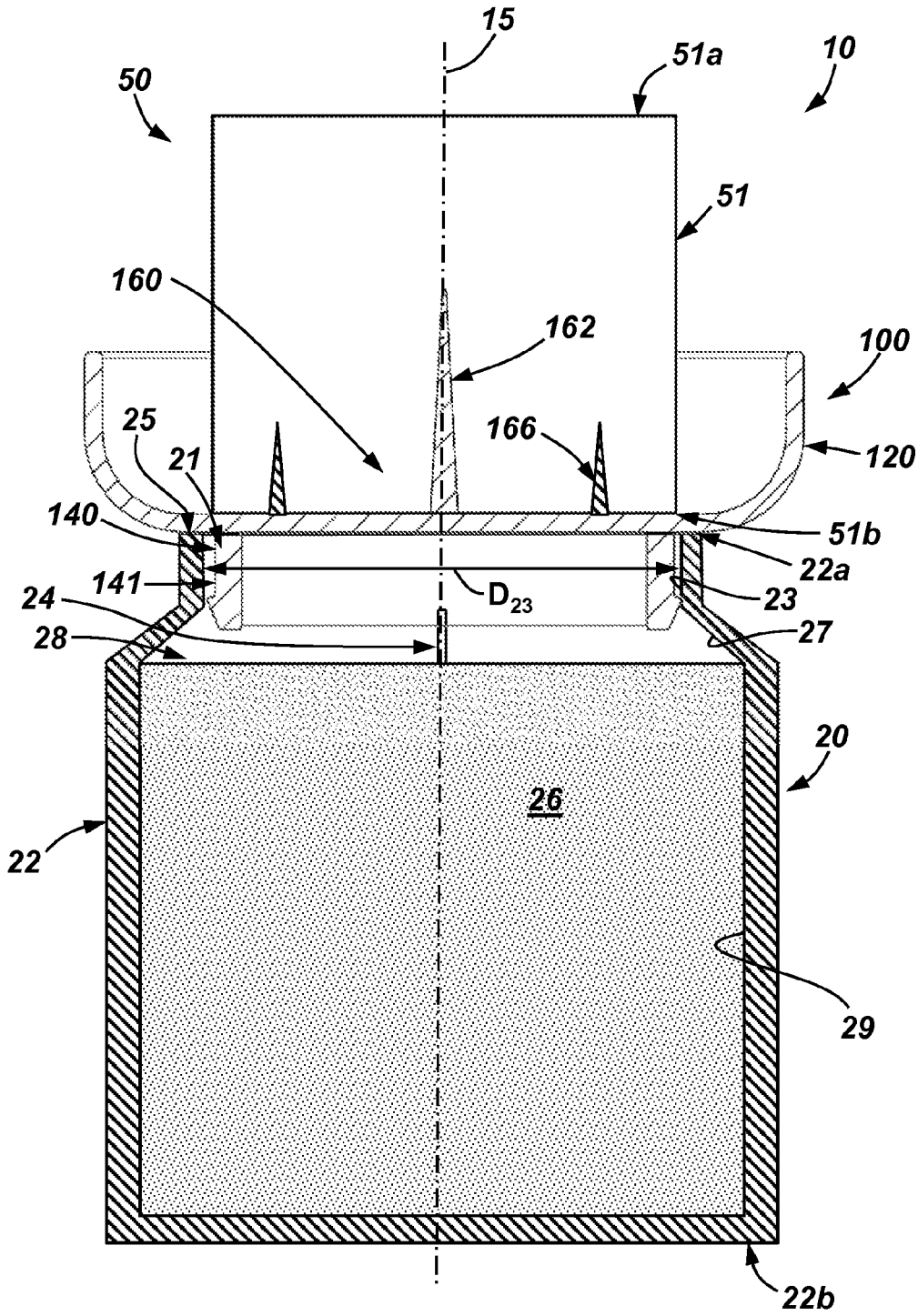
FIG. 1 shows a side cross-sectional view of a flower arrangement assembly in accordance with the principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, wherein a decorative assembly 10 for displaying an arrangement of flowers or other articles of interest is shown. It should be noted that, no flowers are actually shown within assembly 10. Assembly 10 generally comprises a central, longitudinal axis 15, a candle 20, a flower bowl assembly 100, and a mounting insert 50. Each of these components will be described in more detail below.

Referring still to FIG. 1, candle 20 includes a candle jar 22 which further includes a first or upper end 22*a*, a second or lower end 22*b* opposite the upper end 22*a*, and an inner hollow region or receptacle 28 extending axially downward from the upper end 22*a*. The upper end 22*a* comprises a substantially planar surface 25 oriented radially and extending generally circumferentially about the axis 15. The receptacle 28 is generally defined by a substantially cylindrical surface 23 extending axially downward from the upper end 22*a*, a generally downward facing frustoconcial surface 27 extending from the surface 23, and a substantially cylindrical surface 29 extending axially downward from the surface 27. The surface 23 defines an opening 21 to the jar 22 and includes a diameter $D_{23}$ extending substantially radially to the axis 15.

The receptacle 28 includes an amount of candle wax 26 disposed therein. Wax 26 may be any suitable wax or similar material used for making candles while still complying with the principles disclosed herein. In some embodiments, wax 26 includes a scent which is emanated into the local environment surrounding candle 20 when the opening 21 is unobstructed. A wick 24 is disposed within wax 26 substantially along the axis 15. In some embodiments, wick 24 comprises a flammable material, and is configured to be ignited. When wick 24 is ignited the portion of wax 26 that is proximate he burning wick 24 is melted, thus enhancing the emanation of any scent included therein.

Figure 2:
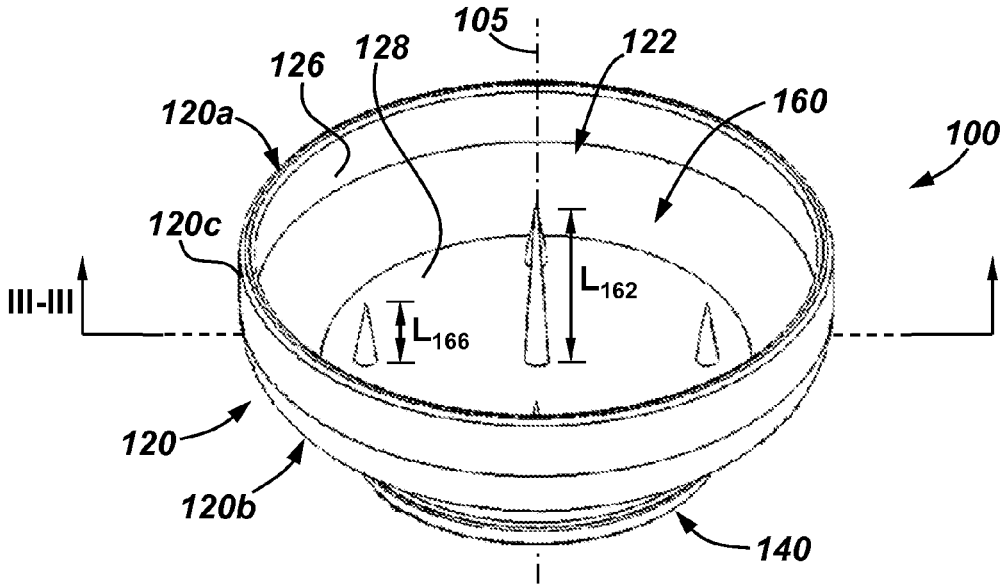
FIG. 2, shows a perspective view of the flower bowl assembly of the flower arrangement assembly of FIG. 1.
Figure 3:
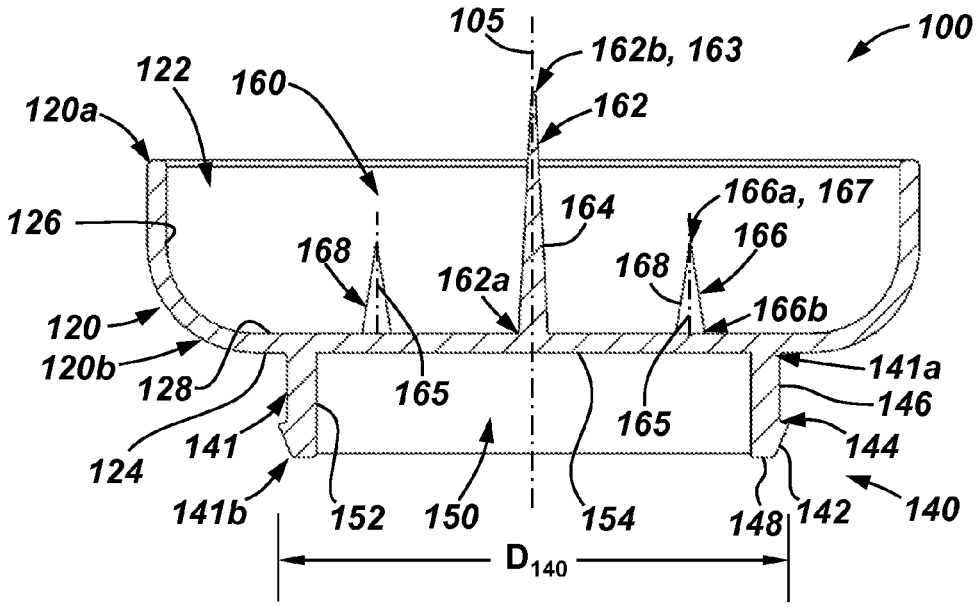
FIG. 3 shows a side-cross-sectional view of the flower bowl along section III-III in FIG. 2.

Referring now to FIGS. 2 and 3, flower bowl assembly 100 generally comprises a central axis 105 that is substantially aligned with the axis 15 during operation, a flower bowl 120, a candle jar engagement assembly 140, and a mounting assembly 160. Bowl 120 includes a first or open end 120*a*, a second or closed end 120*b* opposite the open end 120*a*, and a receptacle 122 extending axially downward from the open end 122*a*. Receptacle 122 is substantially defined by a first or upper generally cylindrical surface 126 extending axially downward from the open end 120*a*, and a second or lower radially oriented generally planar surface 128 extending from the surface 126. The interface between the surfaces 126 and 128 is generally rounded or beveled to ensure a smooth transition therebetween. However, it should be appreciated that in other embodiments, no rounding or beveling may be included between the surfaces 126, 128 while still complying with the principles disclosed herein. Further, lower end 120*b* of bowl 120 comprises a substantially planar surface 124.

Engagement assembly 140 generally includes a projection 141 extending generally axially downward from the surface 124 disposed at the closed end 120*b* of bowl 120. Projection 141 includes a first or proximal end 141*a*, a second or distal end 141*b* opposite the proximal end 141*a*, and a recess 150 extending axially upward from the distal end 141*b*. Projection 141 further includes a radially oriented generally planar surface 148 disposed at the distal end 141*a*, a generally frustoconical surface 142 extending axially upward from the surface 148, a radially oriented shoulder 144 extending radially inward from the surface 142, and a generally cylindrical surface 146 extending axially between the shoulder 144 and the upper end 141*a*. Further, the recess 150 is substantially defined by a generally cylindrical surface 152 extending axially upward from the surface 148, and a radially oriented generally planar surface 154. Further, projection 141 includes a diameter $D_{140}$ generally measured between the widest radial points of projection 141 about the axis 105 (e.g., between radially opposite points of intersection between the surfaces 144 and 142). In some embodiments, the diameter $D_{140}$ is preferably less than the diameter $D_{23}$ of the jar 22 previously described.

Figure 4:
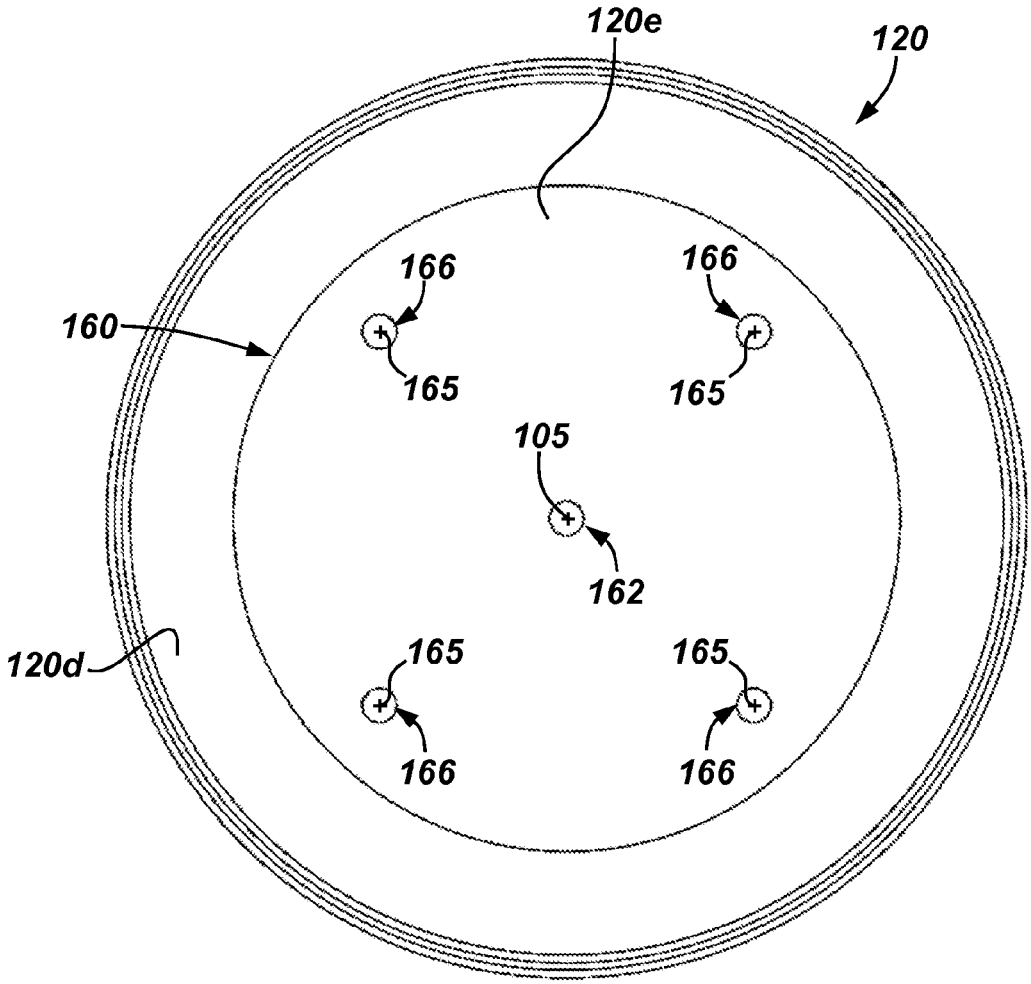
FIG. 4 shows a top view of the flower bowl assembly of FIG. 2.

Referring now to FIGS. 2-4, mounting assembly 160 generally comprises a first or central spike or projection 162 extending axially upward from the surface 128, and a plurality of second or radially adjacent spikes or projections 166. In this embodiment, a total of four projections 166 are included, although other than four projections are possible in other embodiments. In the embodiments of FIGS. 2-4, each projection 166 is disposed every 90° about the axis 105 and thus also about the projection 162. Projection 162 is substantially aligned with the axes 105, 15 and generally includes a first or proximal end 162*a*, a second or distal end 162*b* opposite the proximal end 162*a*, and a conical surface extending between the ends 162*a, b*. In this embodiment, distal end 162*b* comprises a point 163. Further, as is best shown in FIG. 2, the projection 162 has an axial length $L_{162}$ extending between the ends 162*a, b*. Each of the projections 166 includes a central longitudinal axis 165 that is substantially aligned with and radially offset from the axis 105, a first or proximal end 166*a*, a second or distal end 166*b* opposite the proximal end 166*a*, and a conical surface extending between the ends 166*a, b*. In this embodiment, distal end 166*a* of each projection comprises a point 167. Further, as is best shown in FIG. 2, each of the projections 166 has an axial length $L_{166}$ extending between the ends 166*a, b*. Still further, in this embodiment, the axial length $L_{166}$ of each of the projections 166 is less than the axial length $L_{162}$ of the projections 162. As will be described in more detail below, the point 163 on the projection 162 and the point 167 on each of the projections 166 are inserted within the axially lower end of insert 50 in order to secure insert 50 within the bowl 120 during operation.

Assembly 100 may comprise any suitable material for forming a bowl or receptacle for storing or holding other liquids or solids. For example, in some embodiments, assembly may comprise a metal, a polymer, a ceramic, wood, glass, a composite, or a combination thereof. In this embodiment, assembly 100 comprises a plastic. Additionally, in this embodiment, bowl is monolithically formed; however, it should be appreciated that in other embodiments, the components of assembly 100 may not be monolithically formed while still complying with the principles disclosed herein.

Referring back now to FIG. 1, in some embodiments mounting insert 50 generally includes a substantially cylindrical body 51 which further includes a first or upper end 51*a* and a second or lower end 51*b* opposite the upper end 51*a*. In some embodiments, insert 50 may comprise any porous material that is capable of retaining a volume of liquid (e.g., water) but while still retaining enough rigidity to support the stems of flowers or other decorative elements that are inserted therein. For example, in some embodiments, insert may comprise foam, such as, for example, OASIS® Floral Foam available from Oasis Floral Products located in Kent, Ohio.

Referring still to FIG. 1, during assembly, flower bowl assembly 100 preferable is axially disposed above the candle 20 such the projection 141 is installed within the jar 22. In particular, projection 141 is lowered along axis 15 into the jar opening 21 such that the surface 142 slidingly engages with the surface 23 until the surface 25 abuts the surface 124 and wick 24 is substantially disposed within the recess 150. In some embodiments, a sealing member (not shown) such as a fitment is disposed between the surface 23 and the projection 141 in order to create a substantially air tight seal when the projection 141 is disposed within the jar 22. Thereafter, insert 50 may be installed within bowl 120 by inserting the points 163, 167 of the projections 162, 166, respectively into the lower end 51*b* of insert 50 until the lower end 51*b* abuts the surface 128. Further, once insert 50 is fully installed within receptacle 122 of bowl 120, flowers or other decorative elements (not shown) may be placed within the upper end 50*a* of insert such that they retain their relative positions therein. Additionally, in some embodiments, a liquid (e.g., water) may be poured or otherwise placed within receptacle 122 of bowl 120 such that insert 50 may absorb the liquid proximate the lower end 50*b* due to the porous nature of the material comprising insert 50. Thus, flowers (not shown) installed within the insert 50 may utilize the absorbed liquid in order to prolong the shelf life of the arrangement.

Thus, through use of a flower bowl assembly 100 in accordance with the principles disclosed herein, one may conveniently purchase or exchange an arrangement of flowers along with a separate keepsake (e.g., candle 20). Accordingly, once the flowers eventually wither and decay within the bowl, the recipient of the gift may simply remove assembly 100 from the candle 22 and dispose of the decaying flowers in order to fully enjoy and/or use the candle 20 thereafter.

While embodiments disclosed herein have disclosed and described only one wick 24 being substantially aligned with the axis 15 of candle 20, it should be appreciated that more or less than one wick may be used and each of the wicks 24 may occupy a large number of arrangements within candle 20 while still complying with the principles disclosed herein. For example, in some embodiments, multiple wicks 24 may be used within candle 20, such that each is radially offset from the axis 15. Additionally in other embodiments, no wick 24 may be included within candle 20. Further, while embodiments described and disclosed herein have included a single projection 162, and a total of four projections 166, it should be appreciated that in other embodiments, the number and arrangement of the projections 162, 166 within receptacle 122 of bowl 120 may be varied while still complying with the principles disclosed herein. Still further, in some embodiments, no projections 162 and/or 166 may be included on assembly 100 while still complying with the principles disclosed herein. It should also be appreciated that in some embodiments, imitation flowers (e.g., silk) may be placed within bowl 120 while still complying with the principles disclosed herein.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A flower arrangement assembly, comprising a candle jar, with a recess, the recess including an opening with a first diameter D1;

a flower bowl, further comprising:

a body including a central axis, a first end, a second end, and a receptacle extending axially therein from the first end, the receptacle configured to receive an arrangement of flowers; and a projection extending from the second end, the projection further comprising a proximal end, a distal end opposite the proximal end, a frustoconical engagement surface and an outer diameter D2;

wherein D2 is less than D1; and wherein the projection is received within the opening.

2. The flower arrangement assembly of claim 1, wherein the projection further includes a recess extending axially upward from the distal end.

3. The flower arrangement assembly of claim 1, further comprising a plurality of spikes extending axially upward from the receptacle.

4. The flower arrangement assembly of claim 3, further comprising a mounting insert disposed within the receptacle such that the plurality of spikes penetrate into the insert.

5. The flower arrangement assembly of claim 4, wherein the mounting insert comprises a porous material.

6. The flower arrangement assembly of claim 5, wherein the mounting insert is configured to receive and support a stem of a flower therein.

* * * * *